US011179775B2

(12) United States Patent
Liu et al.

(10) Patent No.: US 11,179,775 B2
(45) Date of Patent: Nov. 23, 2021

(54) FLOW-CONTROLLABLE TUNDISH STRUCTURE CAPABLE OF FILTERING INCLUSIONS IN MOLTEN STEEL

(71) Applicant: BAOSHAN IRON & STEEL CO., LTD., Shanghai (CN)

(72) Inventors: Xufeng Liu, Shanghai (CN); Zhengjie Fan, Shanghai (CN); Jianjun Zhi, Shanghai (CN); Hongguang Zheng, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 0 days.

(21) Appl. No.: 17/042,313

(22) PCT Filed: Feb. 28, 2019

(86) PCT No.: PCT/CN2019/076420
§ 371 (c)(1),
(2) Date: Sep. 28, 2020

(87) PCT Pub. No.: WO2019/184647
PCT Pub. Date: Oct. 3, 2019

(65) Prior Publication Data

US 2021/0016346 A1 Jan. 21, 2021

(30) Foreign Application Priority Data

Mar. 30, 2018 (CN) ..... 201810291164.2

(51) Int. Cl.
*B22D 11/119* (2006.01)
*B22D 43/00* (2006.01)
*B22D 41/08* (2006.01)

(52) U.S. Cl.
CPC ..... *B22D 43/004* (2013.01); *B22D 11/119* (2013.01); *B22D 41/08* (2013.01)

(58) Field of Classification Search
CPC ..... B22D 11/116; B22D 11/119; B22D 41/08; B22D 43/00; B22D 43/004
See application file for complete search history.

(56) References Cited

U.S. PATENT DOCUMENTS 5,511,766 A * 4/1996 Vassilicos ..... B22D 11/11 266/78
5,882,577 A * 3/1999 Zacharias ..... B22D 11/11 266/45

FOREIGN PATENT DOCUMENTS

CN 201124222 10/2008
CN 101774014 7/2010
(Continued)

OTHER PUBLICATIONS

International Search Report and Written Opinion dated Apr. 29, 2019 for PCT Patent Application No. PCT/CN2019/076420.
Liang, Xinteng, "Mathmatical and Physical Simulation Study on Flow Behavior of Molten Steel in Continuous Casting Tundishes", China Academic Journal Electronic Publishing House, 1994-2020, pp. 41-45, http://www.cnki.net.
(Continued)

*Primary Examiner* — Kevin E Yoon
(74) *Attorney, Agent, or Firm* — Lei Fang; Smith Tempel Blaha LLC

(57) ABSTRACT

Disclosed is a flow-controllable tundish structure capable of filtering inclusions in molten steel. The tundish structure comprises a tundish (1), the tundish being divided into three separated cavities which comprise an impact zone cavity (1*a*) in the middle and pouring zone cavities (1*b*) at two sides thereof. A long nozzle (2) for pouring is vertically arranged in the center of the impact zone cavity, and molten steel flows down out of the long nozzle for pouring and is injected into the impact zone cavity; and a turbulence suppressor (3) directly facing the long nozzle for pouring is arranged on the cavity bottom under the long nozzle for pouring, and the molten steel flowing down out of the long nozzle for pouring impacts on the turbulence suppressor and is then buffered and mixed. Filter assemblies (A) are respec-
(Continued)

tively arranged between the impact zone cavity and the pouring zone cavities at the two sides, and the buffered and mixed molten steel in the impact zone cavity is filtered by the filter assemblies and is then delivered into the pouring zone cavities at the two sides. Discharge ports (4) are respectively arranged in the bottom of the pouring zone cavities, and the molten steel filtered by the filter assemblies flows into the pouring zone cavities and then flows out from the discharge ports. The flow-controllable tundish structure has the advantages of a simple structure, easy building and lower cost, and has a good liquid steel purification effect.

7 Claims, 2 Drawing Sheets

(56) References Cited

FOREIGN PATENT DOCUMENTS

| | | | | | |
|---|---|---|---|---|---|
| CN | 202571273 | | | 12/2012 | |
| CN | 202845761 | | | 4/2013 | |
| CN | 104439136 | | | 3/2015 | |
| CN | 106670445 | | | 5/2017 | |
| JP | 63126656 | A | * | 5/1988 | ..... B22D 11/119 |
| JP | H10216909 | | | 8/1998 | |
| KR | 20030044589 | | | 6/2003 | |

OTHER PUBLICATIONS

Sahai et al., "Melt Flow Characterization in Continuous Casting Tundishes", ISIJ International, vol. 36 (1996), No. 6, pp. 667-672.

* cited by examiner

FLOW-CONTROLLABLE TUNDISH STRUCTURE CAPABLE OF FILTERING INCLUSIONS IN MOLTEN STEEL

CROSS-REFERENCE TO RELATED APPLICATIONS

This application is a 371 U.S. National Phase of PCT International Application No. PCT/CN2019/076420 filed on Feb. 28, 2019, which claims benefit and priority to Chinese patent application no. 201810291164.2 filed on Mar. 30, 2018, the contents of both are incorporated by reference herein in their entireties.

TECHNICAL FIELD

The present disclosure relates to the field of iron and steel metallurgy production, in particular to a flow-controllable tundish structure capable of filtering and decreasing inclusions in molten steel, improving the flow of a continuous casting tundish, and facilitating uniform temperature of molten steel in the tundish.

BACKGROUND ART

At present, a high-purity casting billet is the basis for producing high-quality steel in the field of iron and steel metallurgy production, the purity of the casting billet mainly depends on the treatment process before a fluid flows into a crystallizer, and tundish metallurgy is one of the important processes. The flow state and velocity distribution of a fluid in a tundish have an important influence on the uniformity of composition and temperature of the fluid and the rising and removal of inclusions, and the structures of the tundish and its flow control device determine the flow state of the fluid in the tundish.

Since the 1970s, many researchers at home and abroad have systematically studied the distribution of flow fields in different tundishes by means of physical simulation and mathematical simulation, and have arranged flow control devices such as dams, weirs and turbulence controllers in the tundishes to explore the optimal flow state in the tundishes. The reasonable structures of the flow control devices not only can improve the flow state and the speed distribution of molten steel in the tundishes, but also can reduce the temperature difference of the areas near discharge ports, prolonging the residence time of the molten steel in the tundishes, facilitating the full rising and removal of non-metallic inclusions in the molten steel, being beneficial to purifying the molten steel in the tundishes and improving the quality of casting billets, and can also prolong the service life of a refractory material.

By the 1980s, people also started to mount diversion partition walls, filters, etc. in the tundishes for study on the basis of arranging the weirs and dams, so as to further change and optimize the flow state of molten steel and improve the removal effect of inclusions; after the 1990s, argon was blown into the tundishes, and molten steel was stirred using an inert gas, such that collision, growth and rising of tiny particle inclusions in the steel were promoted; and by this century, the comprehensive application of various molten steel flow control devices has been widely popularized.

After long-time operation feedback of on-site workers, tundishes for various high-purity casting billets in the prior art have many problems during practical applications as follows:

1. Conventional filter retaining walls of the tundishes are prone to blockage;
2. Tiny inclusions are difficult to filter and accordingly are involved into crystallizers; and
3. Conventional filter retaining walls need to be replaced after being blocked, so that the continuity and the efficiency of a casting operation are affected.

In summary, there is currently a need for a novel tundish structure capable of effectively filtering inclusions in molten steel without frequent replacement to improve the continuity and efficiency of a casting operation.

SUMMARY OF THE INVENTION

In order to solve the above-mentioned problems, the present disclosure provides a flow-controllable tundish structure capable of filtering inclusions in molten steel. The tundish structure has the characteristics of a simple structure, easy building and a low cost, and has a good molten steel purification effect.

The flow-controllable tundish structure capable of filtering inclusions in molten steel of the present disclosure has a specific structure as described below:

a flow-controllable tundish structure capable of filtering inclusions in molten steel comprises a tundish, wherein the tundish is divided into three separated cavities which comprise an impact zone cavity in the middle and pouring zone cavities at two sides;

a long nozzle for pouring is perpendicularly arranged in the center of the impact zone cavity, and molten steel flows down out of the long nozzle for pouring and is injected into the impact zone cavity; a turbulence suppressor directly facing the long nozzle for pouring is arranged at the bottom of the cavity under the long nozzle for pouring, and the molten steel flowing down out of the long nozzle for pouring collides with the turbulence suppressor and is then buffered and mixed;

filter assemblies are respectively arranged between the impact zone cavity and the pouring zone cavities at the two sides, and the buffered and mixed molten steel in the impact zone cavity is filtered by the filter assemblies and is then delivered into the pouring zone cavities at the two sides; and discharge ports are respectively arranged at the bottoms of the pouring zone cavities, and the molten steel filtered by the filter assemblies flows into the pouring zone cavities and then flows out from the discharge ports.

In the flow-controllable tundish structure capable of filtering inclusions in molten steel according to the present disclosure, the filter assembly comprises a slag retaining filter wall, a retaining wall diversion slot, a retaining wall diversion hole, a retaining dam and a retaining dam diversion hole, wherein the slag retaining filter wall is arranged between the impact zone cavity and the pouring zone cavity and connects the impact zone cavity and the pouring zone cavity, and the thickness of a lower bottom of the slag retaining filter wall is greater than that of an upper top; the retaining wall diversion slot is provided in the bottom of the slag retaining filter wall, the retaining wall diversion slot penetrates through the slag retaining filter wall, and the retaining wall diversion slot is arranged to tilt downward 30°; and the retaining wall diversion hole is arranged at the bottom of the slag retaining filter wall in a way of penetrating through the slag retaining filter wall; the retaining dam is perpendicularly arranged at the bottom, close to the retaining wall diversion slot, of the pouring zone cavity, and the shape and the size of the retaining dam correspond to a cross section of a lower portion of the pouring zone cavity;

the retaining dam diversion hole penetrating through the retaining dam is arranged in the middle of the bottom of the retaining dam; and molten steel flows into the pouring zone cavity from the impact zone cavity through the retaining wall diversion slot and the retaining wall diversion hole, most of the molten steel flows over the retaining dam when passing through the retaining dam, a small part of the molten steel flows through the retaining dam diversion hole in the middle of the bottom of the retaining dam, and finally all the molten steel flows out to a crystallizer through the discharge port.

In the flow-controllable tundish structure capable of filtering inclusions in molten steel according to the present disclosure, the thickness of the lower bottom of the slag retaining filter wall is greater than that of the upper top, and to be specific, the thickness of the lower bottom of the slag retaining filter wall is 2-2.5 times greater than the thickness of the upper top, that is, the whole slag retaining filter wall is trapezoidal.

In the flow-controllable tundish structure capable of filtering inclusions in molten steel according to the present disclosure, the number of the retaining wall diversion slots is 4-6, the interior of the retaining wall diversion slot is stepped or curved, the retaining wall diversion slots are parallel to one another, and the molten steel forms upper, middle and lower multi-stage flows when passing through the retaining wall diversion slots.

Stepped or curved slot structures allow a molten steel stream to collide here, so that the probability of collision and growth of tiny inclusions is increased, filtration is facilitated, and the stepped or curved slot structures also provide a large enough surface area to make inclusion particles in the molten steel through which the particles flow be adhered and captured to the maximum extent, thereby decreasing the quantity of inclusions entering the crystallizer.

By using the flow-controllable tundish structure capable of filtering inclusions in molten steel of the present disclosure, the following beneficial effects are obtained:

1. The flow-controllable tundish structure capable of filtering inclusions in molten steel of the present disclosure has a simple structure, easy building and low cost, the impact zone thereof accounts for 30% or above of the effective volume of the whole tundish, and the volume ratio is reasonable;

2. According to the flow-controllable tundish structure capable of filtering inclusions in molten steel of the present disclosure, when molten steel flows through gaps of the diversion slots, the molten steel stream is allowed to collide here due to the stepped or curved slot structures, so that the probability of collision and growth of the tiny inclusions is increased, and filtration is facilitated;

3. According to the flow-controllable tundish structure capable of filtering inclusions in molten steel of the present disclosure, the stepped or curved slot structures provide a large enough surface area to make inclusion particles in the molten steel through which the particles flow be adhered and captured to the maximum extent, thereby achieving the purpose of decreasing the quantity of inclusions entering the crystallizer. The problem of filter hole blockage of existing filter retaining walls is effectively solved without reducing the inclusion removal rate; and 4. The flow-controllable tundish structure capable of filtering inclusions in molten steel of the present disclosure can ensure less tendency to blockage and long working time, so that replacement frequency is reduced, the continuity and efficiency of a casting operation are improved, and the purification effect on molten steel is good.

In the figures: 1—Tundish, 1*a*—Impact zone cavity, 1*b*—Pouring zone cavity, 2—Long nozzle for pouring, 3—Turbulence suppressor, 4—Discharge port, A—Filter assembly, A1—Slag retaining filter wall, A2—Retaining wall diversion slot, A3—Retaining wall diversion hole, A4—Retaining dam, and A5—Retaining dam diversion hole.

DETAILED DESCRIPTION OF EMBODIMENTS

A flow-controllable tundish structure capable of filtering inclusions in molten steel of the present disclosure is further described below in conjunction with the accompanying drawings and embodiments.

Embodiments

Figure 1:
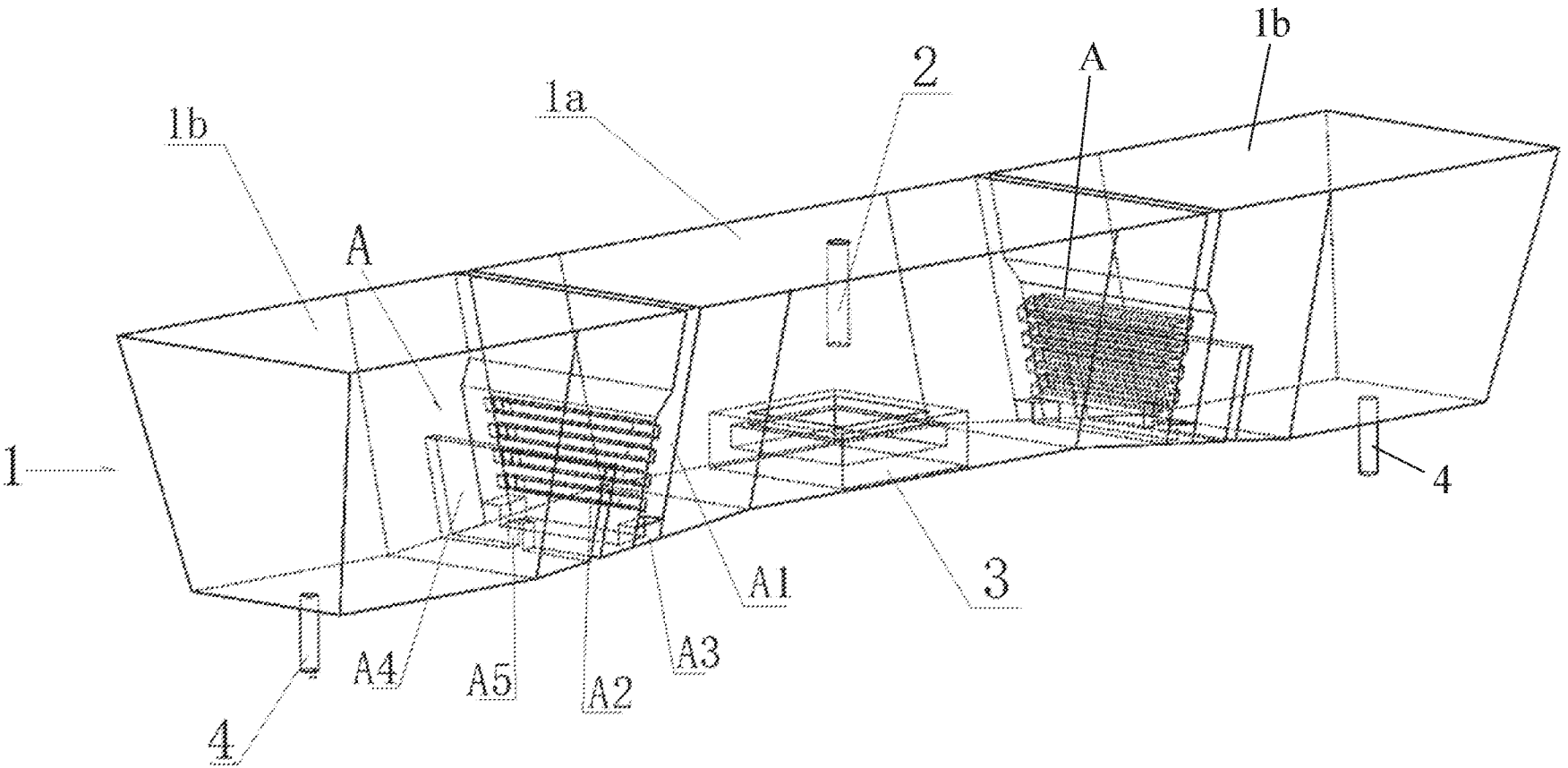
FIG. 1 is a schematic perspective view of a flow-controllable tundish structure capable of filtering inclusions in molten steel of the present disclosure.
Figure 2:
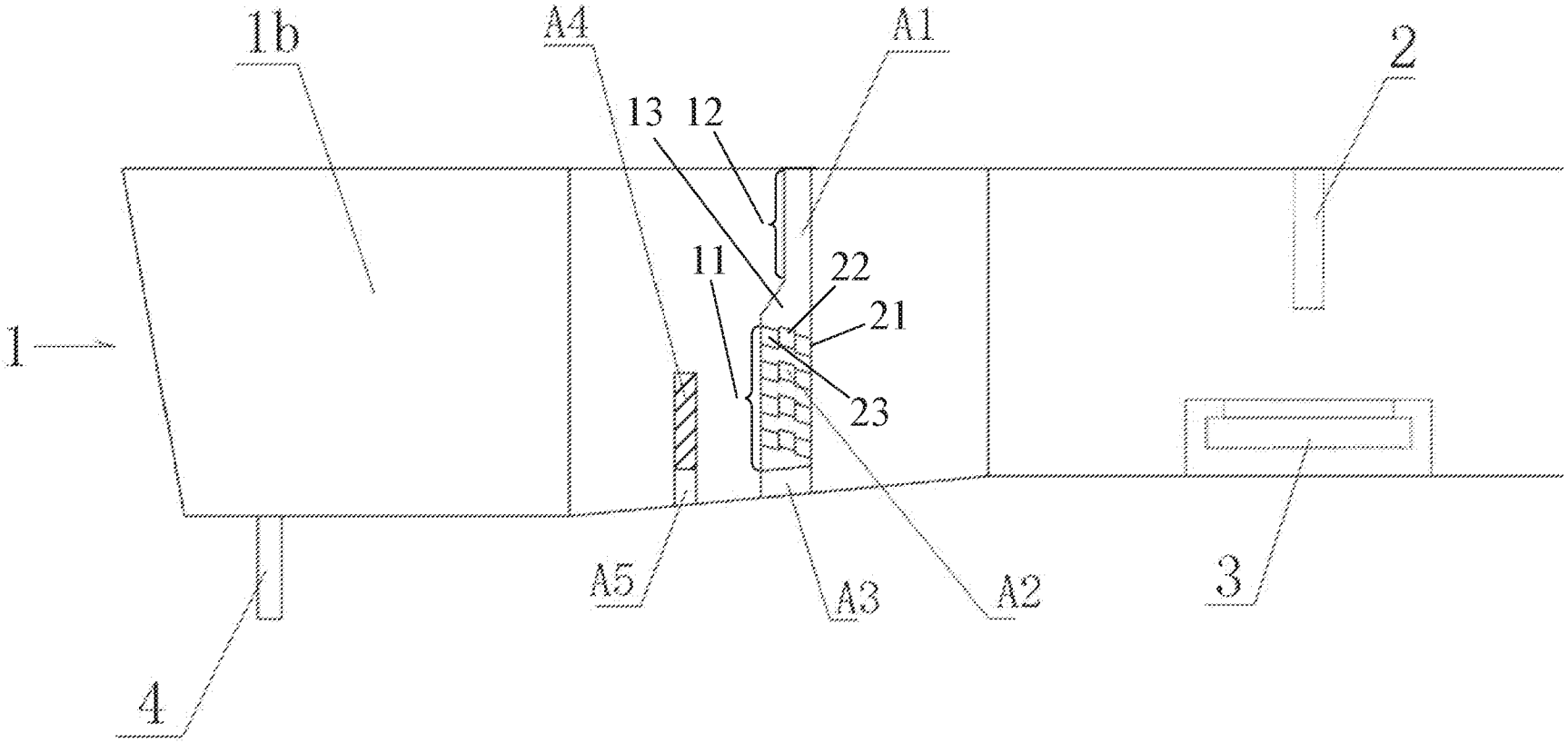
FIG. 2 is a schematic partial front view of the flow-controllable tundish structure capable of filtering inclusions in molten steel of the present disclosure.

FIG. 1 is a perspective view, and FIG. 2 is a front view. FIG. 2 shows cross sections of a retaining dam A4 and a slag retaining filter wall A1. As shown in FIGS. 1 and 2, a flow-controllable tundish structure capable of filtering inclusions in molten steel comprises a tundish 1, wherein the tundish is divided into three separated cavities which comprise an impact zone cavity 1*a* in the middle and pouring zone cavities 1*b* at two sides;

a long nozzle 2 for pouring is perpendicularly arranged in the center of the impact zone cavity 1*a*, and molten steel flows down out of the long nozzle for pouring and is injected into the impact zone cavity 1*a*; a turbulence suppressor 3 directly facing the long nozzle 2 for pouring is arranged at the bottom of the cavity 1*a* under the long nozzle 2 for pouring, and the molten steel flowing down out of the long nozzle 2 for pouring collides with the turbulence suppressor 3 and is then buffered and mixed;

filter assemblies A are respectively arranged between the impact zone cavity 1*a* and the pouring zone cavities 1*b* at the two sides, the impact zone cavity 1*a* and the pouring zone cavities 1*b* at the two sides are separated by the filter assemblies A respectively, and the buffered and mixed molten steel in the impact zone cavity 1*a* is filtered by the filter assemblies A and is then delivered into the pouring zone cavities 1*b* at the two sides; and the pouring zone cavities 1*b* at the two sides form two wings of the impact zone cavity 1*a* which are symmetrically arranged, and the flow-controllable tundish structure shown in FIG. 1 may also be referred to as a dual-flow slab tundish.

Discharge ports 4 are respectively arranged at the bottoms of the pouring zone cavities 1*b*, and the molten steel filtered by the filter assemblies A flows into the pouring zone cavities 1*b* and then flows out from the discharge ports 4.

As shown in FIG. 2, the filter assembly A comprises a slag retaining filter wall A1, a retaining wall diversion slot A2, a retaining wall diversion hole A3, a retaining dam A4, and a retaining dam diversion hole A5, wherein the slag retaining filter wall A1 is arranged between the impact zone cavity 1*a* and the pouring zone cavity 1*b* and connects the impact zone cavity 1*a* and the pouring zone cavity 1*b*; the thickness of a lower bottom or lower portion 11 of the slag retaining filter wall A1 is greater than that of an upper top or upper portion 12, and the retaining wall diversion slot A2 is arranged in the lower bottom or lower portion 11 of the slag retaining filter wall A1; the retaining wall diversion slot A2 penetrates through the slag retaining filter wall A1, and the retaining wall diversion slot A2 is arranged to tilt downward 30°; the retaining wall diversion hole A3 is arranged at the bottom of the slag retaining filter wall A1 in a way of penetrating through the slag retaining filter wall A1; the retaining dam A4 is perpendicularly arranged at the bottom, close to the retaining wall diversion slot A2, of the pouring zone cavity 1*b*, and the shape and the size of the retaining dam A4 correspond to a cross section of the lower portion of the pouring zone cavity 1*b*; the retaining dam diversion hole A5 penetrating through the retaining dam A4 is arranged in the middle of the bottom of the retaining dam A4; and molten steel flows into the pouring zone cavity 1*b* from the impact zone cavity 1*a* through the retaining wall diversion slot A2 and the retaining wall diversion hole A3, most of the molten steel flows over the retaining dam A4 when passing through the retaining dam A4, a small part of the molten steel flows through the retaining dam diversion hole A5 in the middle of the bottom of the retaining dam A4, and finally all the molten steel flows out to a crystallizer (not shown in the figure) through the discharge port 4.

The thickness of the lower bottom or lower portion 11 of the slag retaining filter wall A1 is greater than that of the upper top or upper portion 12, to be specific, the thickness of the lower bottom or lower portion 11 of the slag retaining filter wall is 2-2.5 times (2 times in this embodiment) greater than the thickness of the upper top or upper portion 12, that is, the whole slag retaining filter wall A1 comprises the upper top or upper portion 12, the lower bottom or lower portion 11 and a transitional portion 13, and the transitional portion 13 is trapezoidal and connects the upper top or upper portion 12 and the lower bottom or lower portion 11. The lower portion 11 protrudes relative to the upper portion 12 on the side of the pouring zone cavity 1*b*.

The number of the retaining wall diversion slots A2 is 4-6 (4 in this embodiment). The interior of the retaining wall diversion slot A2 is stepped and comprises an inlet section 21, an intermediate section 22 and an outlet section 23, the sections are arranged to be equal in height, the inlet section 21 and the outlet section 23 are coaxial holes, and the axis of the intermediate section 22 is not collinear with the inlet section 21 and the outlet section 23, so that wall faces of the inlet section 21, the intermediate section 22 and the outlet section 23 are in a stepped form. In addition to the stepped form, the variant forms of the retaining wall diversion slots A2 may be in an arc or other curved forms. The retaining wall diversion slots A2 are parallel to one another, and molten steel forms upper, middle and lower multi-stage flows when passing through the retaining wall diversion slots A2.

The stepped or curved slot structures of the retaining wall diversion slots A2 allow the molten steel stream to collide here, thus the probability of collision and growth of tiny inclusions is increased, and filtration is facilitated.

Theoretically, it is assumed that the volume of a fluid in the tundish consists of interconnected flow zones. On this basis, in actual production, the flow of molten steel in the tundish 1 is divided into: a mixing zone, a piston zone and a dead zone. A simple fluid combination model consisting of the three flow zones has been widely used for the flow of molten steel in tundishes. The mixing zone, the piston zone or the dead zone is divided according to calculated results, and their distribution in the whole tundish is generally not at a unique position, so that the volume fraction of the three zones is the sum of statistics of a plurality of zones. A common flow pattern is that the mixing zone is located near a steel ladle stream (long nozzle 2), and molten steel is mixed with the stream from the steel ladle; the piston zone is created between the mixing zone and a submersed nozzle (discharge port 4), where a fluid is pushed forward and flows with partial back mixing; and the dead zone is adjacent to the piston zone, and the fluid in the zone is slowly exchanged with the outside. An ideal tundish structure and the use of corresponding technologies should create as large a piston zone as possible and as small a dead zone as possible.

Since the flow of the fluid in the tundish 1 belongs to non-ideal flow, such flow may be described mathematically by means of a modified mixing model. The motion trajectories of the fluid in a vessel are not exactly the same, so its residence time is different, and the residence time distribution (RTD) of a fluid mass in the vessel is an important parameter of a continuous flow system. For a stable flow system, in a material quantity Q flowing into (or out of) the device at a certain moment, the fraction dQ/Q of the material quantity dQ with the residence time between t and t+dt is defined as C(t)dt, while an E function is a probability distribution function, such that the average residence time may be described by using its mathematical expectation:

$$\bar{t} = \frac{\Sigma tC(t)}{\Sigma C(t)}$$

when the fluid flows continuously and stably through a vessel, on the basis of the content disclosed in the literature: Sahai Y, Emi T. "Melt Flow Characterization in Continuous Casting Tundishes" [J]. ISIJ International, Vol. 36 (1996), pp: 667-672, and the literature: LIANG, Xinteng "Mathematical and Physical Simulation Study on Flow Behavior of Molten Steel in Continuous Casting Tundishes" [D]. Master's Thesis of Inner Mongolia University of Science and Technology (2003) P43-45, the theoretical residence time $t_a$ of the fluid may be obtained by dividing the volume of the fluid by the volume flow, the average residence time $\bar{t}$ and the stagnation time $t_d$ may be determined by processing a residence time distribution curve (RTD curve), and then the volume of the mixing zone $t_m$, the volume of the piston zone $V_p$, and the volume of the dead zone $V_d$ may be obtained.

In order to evaluate the advantages and disadvantages of the tundish structure, simulated calculation is conducted on the flow and temperature distribution of molten steel in the tundish 1. In consideration of the symmetrical characteristics of two wings of a two-flow slab tundish, only half of the zones thereof is calculated. The corresponding RTD curve is obtained by firstly calculating a stable three-dimensional flow field and a temperature field of a tundish, then continuing to calculate a transient flow field and a transient temperature field of the tundish, meanwhile, calculating a diffusion equation of a tracer in the tundish, and monitoring the change of concentration of the tracer at outlets respectively. Relevant indexes for judging the advantages and disadvantages of the flow field may be obtained by processing curve data.

Comparison of index parameters obtained using a flow-controllable tundish structure capable of filtering inclusions in molten steel of the present disclosure and those obtained without using the present disclosure is shown in the following table.

TABLE 1

Comparison of index parameters of a tundish in use in a steel plant with a flow-uncontrolled structure and those of the arrangement structure of this disclosure

| | Volume of fluid in tundish V ($m^3$) | Theoretical average residence time $t_a$ (s) | Tracer occurrence time $t_{min}$ (s) | Occurrence time of maximum concentration $t_{peak}$ (s) | Average residence time $\bar{t}$ (s) | Volume fraction of piston zone $V_p$ (s) | Volume fraction of dead zone $V_d$ (s) | Volume fraction of mixing zone $V_m$ (s) |
|---|---|---|---|---|---|---|---|---|
| Flow-uncontrolled structure | 5.258 | 356.3 | 19 | 114 | 354.8 | 18.7% | 21.7% | 59.6% |
| Structure of this disclosure | 5.146 | 348.7 | 28 | 148 | 348.6 | 25.2% | 13.1% | 61.7% |

It may be known by a numerical simulation test and evaluation that under the condition of the flow-controllable combination device proposed in the present disclosure, due to the existence of the turbulence suppressor 3, the injected molten steel is firstly fully mixed in a limited impact zone to homogenize components and temperature, and then flows into the pouring zone 1*b* on the other side of the retaining wall A1 via stepped or curved filter slots A2 in the retaining wall A1. Flow streams collide and circle round first when the molten steel passes through the slots A2 in the wall, and then most of the flow streams flow toward the surfaces of two wings of a molten pool in a diversion direction of the slots A2; and a small part of the flow streams of molten steel pushed forward along the bottom of the tundish 1 is forced to rise after encountering the dam A4, the molten steel is uniformly mixed again above the discharge port 4, a diversion hole A5 is arranged in the center, near the bottom of the tundish, of the dam A4, and part of the molten steel at the bottom of the tundish passes through the channel, such that the molten steel on the outer side (the left side in FIG. 2) of the dam A4 is involved into the discharge port 4. In combination with RTD curve analysis, it may be seen that, by means of such flow-controllable filter device combination being mounted in the tundish 1, molten steel in the piston zone within the tundish 1 is increased, the stagnant flow dead zone is decreased, inclusions are easy to rise and remove, the mixing of new and old molten steel in the tundish 1 is accelerated, and the temperature of the molten steel in the tundish is uniform.

In addition, the detection results of the inclusion content in steel billets produced by the flow-controllable tundish structure capable of filtering inclusions in molten steel of the present disclosure show that the removal efficiency of the inclusions in the tundish reaches 48%, and the total oxygen removal rate reaches 21%, among which the total oxygen removal rate of molten steel with an original oxygen content of more than 40 ppm reaches 44.2%. Compared with the detection results of the inclusion content in steel billets produced using the current tundish structure, the rate of first-grade casting billets increases by 10.7%.

The flow-controllable tundish structure capable of filtering inclusions in molten steel of the present disclosure has a simple structure, easy building and low cost, the impact zone thereof accounts for 30% or above of the effective volume of the whole tundish, and the volume ratio is reasonable; when molten steel flows through the gaps of the retaining wall diversion slots A2, the molten steel stream is allowed to collide here due to the stepped or curved slots A2, so that the probability of collision and growth of the tiny inclusions is increased, and filtration is facilitated; and the stepped or curved slots A2 of the present disclosure further provide a large enough surface area to make the inclusion particles in the molten steel through which the particles flow be adhered and captured to the maximum extent, thereby achieving the purpose of decreasing the quantity of inclusions entering the crystallizer. The problem of filter hole blockage of existing filter retaining walls is effectively solved without reducing the inclusion removal rate; and the present disclosure has longer service life, such that replacement frequency is reduced, the continuity and efficiency of a casting operation are improved, and the purification effect on molten steel is good.

The flow-controllable tundish structure capable of filtering inclusions in molten steel of the present disclosure is suitable for the fields in which inclusions in molten steel need to be filtered and decreased, the flow of a continuous casting tundish needs to be improved, and the uniform temperature of molten steel in the tundish needs to be facilitated.

The invention claimed is:

1. A flow-controllable tundish structure, comprising a tundish (1), wherein the tundish (1) comprises an impact zone cavity (1*a*) in the middle and pouring zone cavities (1*b*) at two sides;

a long nozzle (2) for pouring is perpendicularly arranged in the center of the impact zone cavity (1*a*), and a turbulence suppressor (3) directly facing the long nozzle (2) for pouring is arranged at the bottom of the cavity under the long nozzle (2) for pouring;

filter assemblies (A) are respectively arranged between the impact zone cavity (1*a*) and the pouring zone cavities (1*b*) at the two sides, and the buffered and mixed molten steel in the impact zone cavity (1*a*) is filtered by the filter assemblies (A) and is then delivered into the pouring zone cavities (1*b*) at the two sides;

discharge ports (4) are respectively arranged at the bottoms of the pouring zone cavities (1*b*), and the molten steel filtered by the filter assemblies (A) flows into the pouring zone cavities (1*b*) and then flows out from the discharge ports (4); and the filter assembly (A) comprises a slag retaining filter wall (A1) separating the impact zone cavity (1*a*) and the pouring zone cavity (1*b*), the slag retaining filter wall (A1) comprises a retaining wall diversion slot (A2) inclining from the side of the pouring zone cavity (1*b*) to the side of the impact zone cavity (1*a*), and the retaining wall diversion slot (A2) penetrates through the slag retaining filter wall (A1) in a curved form.

2. The flow-controllable tundish structure according to claim 1, wherein the retaining wall diversion slot (A2)

comprises an inlet section (21), an intermediate section (22) and an outlet section (23), wherein the inlet section (21) and the outlet section (23) are coaxial holes, and the axis of the intermediate section (22) is not collinear with the inlet section (21) and the outlet section (23).

3. The flow-controllable tundish structure according to claim 1, wherein a plurality of the retaining wall diversion slots (A2) are arranged in parallel at a lower portion of the slag retaining filter wall (A1).

4. The flow-controllable tundish structure according to claim 3, wherein the slag retaining filter wall (A1) comprises an upper portion (12) and a lower portion (11), the thickness of the lower portion (11) being 2-2.5 times greater than the thickness of the upper portion (12).

5. The flow-controllable tundish structure according to claim 1, wherein the filter assembly (A) further comprises a retaining dam (A4), the retaining dam (A4) is perpendicularly arranged at the bottom, close to the retaining wall diversion slot (A2), of the pouring zone cavity (1*b*), the shape and the size of the retaining dam (A4) correspond to a cross section of a lower portion of the pouring zone cavity (1*b*), and a retaining dam diversion hole (A5) penetrating through the retaining dam is arranged in the middle of the bottom of the retaining dam (A4).

6. The flow-controllable tundish structure according to claim 5, wherein the slag retaining filter wall (A1) further comprises a retaining wall diversion hole (A3), and the retaining wall diversion hole (A3) is arranged at the bottom of the slag retaining filter wall (A1) in a way of penetrating through the slag retaining filter wall (A1); and molten steel flows into the pouring zone cavity (1*b*) from the impact zone cavity (1*a*) through the retaining wall diversion slot (A2) and the retaining wall diversion hole (A3), most of the molten steel flows over the retaining dam (A4) when passing through the retaining dam (A4), a small part of the molten steel flows through the retaining dam diversion hole (A5) in the middle of the bottom of the retaining dam (A4), and finally all the molten steel flows out from the discharge port (4).

7. The flow-controllable tundish structure according to claim 1, wherein an impact zone accounts for 30% or above of the effective volume of the whole tundish.

* * * * *